United States Patent [19]

Wührer

[11] Patent Number: 4,563,940

[45] Date of Patent: Jan. 14, 1986

[54] OIL INFEED DEVICE FOR AN ADJUSTABLE PITCH PROPELLER

[75] Inventor: Wolfgang Wührer, Ravensburg, Fed. Rep. of Germany

[73] Assignee: Escher Wyss GmbH, Ravensburg, Fed. Rep. of Germany

[21] Appl. No.: 482,038

[22] Filed: Apr. 4, 1983

[30] Foreign Application Priority Data

Apr. 15, 1982 [CH] Switzerland ..... 2277/82

[51] Int. Cl.[4] ..... B63H 3/04; B63H 3/08

[52] U.S. Cl. ..... 92/106; 416/157 R; 277/58

[58] Field of Search ..... 416/156, 157 A, 157 R, 416/157 B, 158; 91/418; 92/106, 116; 277/12, 32, 58, 59

[56] References Cited

U.S. PATENT DOCUMENTS

| | | | |
|---|---|---|---|
| 2,630,136 | 3/1953 | Brandes et al. | 416/157 |
| 2,781,856 | 2/1957 | Danvers et al. | 416/157 |
| 4,456,217 | 6/1984 | Winegart et al. | 92/106 |

*Primary Examiner*—Edward K. Look
*Assistant Examiner*—John M. Husar
*Attorney, Agent, or Firm*—Werner W. Kleeman

[57] ABSTRACT

On an intermediate shaft connected to a propeller shaft there are supported a stationary housing and a distributor or separator ring structure limiting two annular passages in the housing which can be selectively impinged with pressurized oil. The annular passages are connected to two oppositely effective working spaces of a servo motor of the adjustable pitch propeller by control passages extending through the intermediate shaft and the propeller shaft. The separator or distributor ring structure comprises axial sections, each of which is formed of one part in circumferential direction and is fixedly connected in axial direction to an axial section thereof associated with the same annular passage by web or bridging members bendable in radial direction. Each axial section is sealingly guided in a cylindrical bore of the housing by a respective sealing ledge protruding from the outer circumferential face thereof. Such arrangement permits elastic deformations of the axial sections in the sense of constricting bearing gaps or clearances formed with the intermediate shaft. Thus, the sealing action thereof is improved. Also, the parts of the housing surrounding the intermediate shaft thus can be formed of one-piece in circumferential direction, thereby requiring only modest machining and assembly work.

6 Claims, 3 Drawing Figures

OIL INFEED DEVICE FOR AN ADJUSTABLE PITCH PROPELLER

CROSS-REFERENCE TO RELATED APPLICATION

This application is related to my commonly assigned, copending U.S. application Ser. No. 467,899, filed Feb. 18, 1983, entitled "Adjustable Propeller for Marine Vessel Drive", now abandoned.

BACKGROUND OF THE INVENTION

The present invention relates to an improved construction of oil infeed device for a hydraulic servo motor of an adjustable pitch propeller.

In the arrangement of the present invention the servo motor is drivable via a hollow intermediate shaft which is arranged within a bore in a housing member secured against rotation. Two oil supply passages in the housing member are connectable to control means for the oil supply and each open into a respective annular passage extending about the circumference of the intermediate shaft. Each annular passage is formed intermediate two axial sections of a distributor ring or ring structure supported at the intermediate shaft. The distributor ring is sealingly guided in the bore of the housing member by annular sealing ledges which extend along the exterior circumference of the distributor ring to both sides of each annular passage. The annular or ring-shaped passages each are in communication with working spaces or chambers of the servo motor through connecting passages or channels formed in the intermediate shaft.

In an oil infeed device as known, for example, from U.S. Pat. No. 2,781,857, granted Feb. 19, 1957, the annular passages extending along the intermediate shaft are arranged in a distributor ring forming a rigid sleeve and which is provided, in addition to sealing rings extending at the exterior circumference thereof, with corresponding sealing rings arranged in grooves at the interior circumferential face or surface of the distributor ring. Thus, the annular passages are sealed at the region of the running surfaces of the intermediate shaft in axial direction with respect to each other and with respect to the surroundings. In the state-of-the-art design of the oil infeed device, the inner sealing rings which are arranged intermediate the stationary sleeve and the rotating intermediate shaft are particularly subjected to considerable wear, and thus, require, due to the necessary relatively frequent exchange of the sealing rings which are accessible only with difficulty, a correspondingly great amount of assembly and maintenance work since, whenever the sealing rings have to be exchanged, the intermediate shaft has to be disassembled.

In another design of an oil infeed device as known, for example, from U.S. Pat. No. 2,786,539, granted Mar. 26, 1957, the two annular passages or channels are formed in two distributor rings separated from one another, each of which, however, is rotatably journalled with the outer circumferential surface thereof in a housing member, and each of which is sealingly and rigidly connected for rotation with the propeller shaft by two sealing rings arranged on both sides of the respective annular passage. Each of the distributor rings is arranged between two annular-shaped sealing units each comprising a sealing washer engaging the wall of the bore in the housing member and a sealing ring engaging the respective end wall of the distributor ring. Apart from the disadvantageous arrangement of the sliding surfaces or faces at the outer circumference instead of at the inner circumference of the distributor rings, the sealing rings which coact with the rotating distributor rings and which are stationarily held in the housing also, in this known design, constitute members which are subjected to wear. Consequently, they have to be exchanged rather frequently, which exchange operation requires each time disassembly of the propeller shaft. Furthermore, the oil, which is heated in the bearing gaps or clearances, cannot flow off to the exterior in this prior art design, since the pressure prevailing between the distributor ring and the sealing units in each case is the same as in the related annular passage.

SUMMARY OF THE INVENTION

Therefore, with the foregoing in mind it is a primary object of the present invention to provide a new and improved oil infeed device for an adjustable pitch propeller which is of a simplified construction and enables the use of components or parts which can be manufactured in a simple manner.

Another important object of the present invention is directed to the provision of a new and improved oil infeed device for an adjustable pitch propeller and which possesses a simplified construction, wherein the load exerted upon the components or parts is relatively small so that they are subjected to only slight wear and require only very little maintenance.

Now in order to implement these and still further objects of the invention, which will become more readily apparent as the description proceeds, the oil infeed device of the present development is manifested by the features that, each section of the distributor ring comprises a seal-less internal bearing surface or face which is suitable for limiting a bearing gap or clearance formed with the intermediate shaft and which is open in both axial directions. Each section also comprises a greatest exterior or outer diameter which is smaller than the diameter of the bore in the housing member by a clearance or play permitting adjustment movements of the relevant section of the distributor ring. Moreover, the sections of the distributor ring associated with the same annular passage or channel are interconnected by holding or holder means which are flexible or yieldable in radial direction.

The oil infeed device according to the invention has an inventive construction of the distributing and sealing arrangement which, already due to the groove-free bearing surfaces or faces on the distributor ring, results in a particularly structurally simple and operationally reliable design of the coacting members, particularly at the region of the two bearing gaps or clearances, each of which contiguously merges with a respective annular passage subjected to pressurized oil. In the bearing gaps or clearances, through which can flow substantially free of obstruction in axial direction the pressurized oil which exits from the related annular passage in both axial directions, there is formed from such pressurized oil a lubricant film which is effective over the entire axial extent of the related bearing surface or face. The pressurized oil which has been heated in the bearing gap flows off towards the exterior and is replaced by fresh pressurized oil. In corresponding manner there is ensured that the stationary distributor ring is supported upon the rotating intermediate shaft with particularly low wear and that the coacting bearing surfaces are effectively cooled.

To ensure a positive or safe seal which is independent of relative movements of the intermediate shaft and the housing supported thereon, it is advantageous if the sealing ledges of the distributor ring are each made of a flexible or yieldable material or are supported at the respective section of the distributor ring so as to be flexible or yieldable in radial direction.

To ensure for the differing adjustments or settings of the sections of the distributor ring subjected to the oil pressure as a function of the pressure conditions during oil supply, it is advantageous for the holding means to comprise a number of web or bridging members distributively arranged in circumferential direction about the annular passage or channel and which are flexible in radial direction. The webs or web members are fixedly connected to the two axial sections of the distributor ring and delimit radial openings. Thus, the ring sections each may perform a kind of tilting movement about the marginal portion of the sealing ledge which protrudes from the outer circumferential surface of the ring sections, which marginal portions are adjacent to the related annular passage subjected to pressure and engage the housing member. Each of the ring sections are thus subjected to a corresponding elastic deformation which acts in the sense of constricting the opening of the bearing gap or clearance formed between the respective axial section of the distributor ring and the intermediate shaft and facing the annular passage which is subjected to pressure. By virtue of such slight elastic deformations, only occurring within the limits governed by the size of the bearing gap or clearance, the sealing action of the ring sections under the action of the oil pressure can be intensified in a simple manner and also can be ensured for in designs comprising a relatively large bearing gap or clearance in the unloaded state.

To ensure that there is maintained an operationally most favorable position of the coacting members in the oil infeed device according to the invention, particularly the sealing connection on the side of the housing between stationary surfaces, it is advantageous if the distributor ring and the housing member are fixedly coupled at least in circumferential direction.

According to a particularly advantageous design of the oil infeed device according to the invention, a balance or compensation of the pressure forces acting on the inner and on the outer circumferential surfaces of each axial section, can be at least approximately achieved in that the axial length of the axial sections of the distributor ring which limit or bound the related annular passage or channel is at least approximately twice as large as the axial distance or spacing between the end face of the section which faces the annular passage and the line of contact between the sealing ledge and the wall of the bore of the housing member which is adjacent to the last mentioned annular passage.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
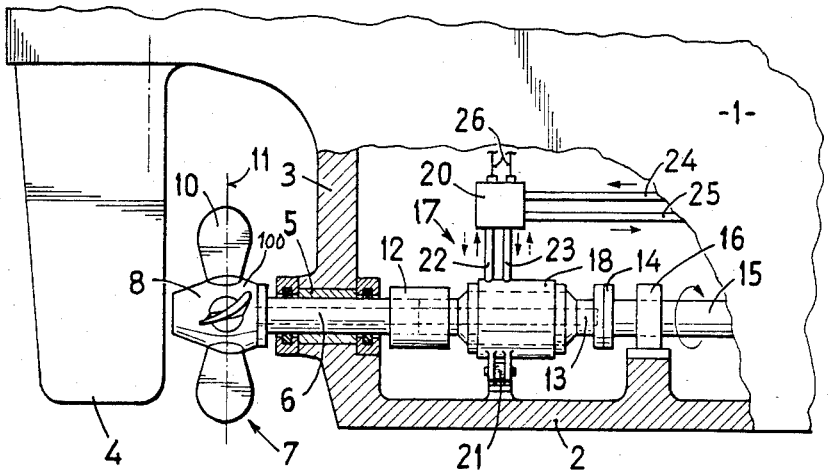
FIG. 1 is a partial sectional view through the stern portion of a vessel equipped with an adjustable pitch propeller and an oil infeed device therefor according to the invention.

Describing now the drawings, the stern portion of a hull 1 of a vessel as shown in FIG. 1 comprises a floor or hull bottom 2, a stern wall or bulkhead 3 and a control rudder 4. In the stern wall or bulkhead 3 there is rotatably mounted or journalled a hollow propeller shaft 6 in a shaft bearing 5 which is sealed at both of its ends, and the outwardly protruding end of which carries an adjustable pitch propeller 7. The adjustable pitch propeller 7 comprises a hub 8 which is fixedly connected to the propeller shaft 6, and propeller vanes 10 supported at the hub 8. The propeller vanes 10 are adjustable in a manner known as such by means of a conventional hydraulic servo motor, merely generally indicated by reference character 100 in FIG. 1, about an axis of rotation 11 which extends transversely with respect to the axis of the propeller shaft 6. The hydraulic servo motor 100 is arranged within the hub 8. The other end of the propeller shaft 6 is connected in the interior of the vessel to a hollow intermediate shaft 13 by means of a shrink-fitted clutch or coupling sleeve 12, and the intermediate shaft 13 is coupled to a drive shaft 15 via coupling flanges 14. The drive shaft 15 is connected to any appropriate drive means (not shown) located in the interior of the vessel and is journalled in bearings 16, of which only one is shown in the drawing, these bearings 16 being mounted on the floor or hull bottom 2 of the vessel.

The servo or positioning motor 100 of the adjustable pitch propeller 7 is connected to an oil infeed device 17 via the hollow propeller shaft 6 and the hollow intermediate shaft 13. The oil infeed device 17 comprises a housing or housing member 18 supported at the intermediate shaft 13 and a control means 20. A torque sensitive support 21 is linked to the housing member 18 at one of its ends and the other end of which is linked to the floor or hull bottom 2. Thus, the housing member 18 is secured against rotation. Two control lines or conduits 22 and 23 which selectively can serve as supply line or drain line for hydraulic oil serve to connect the housing member 18 to the control means 20. The control means 20, for example, may also be mounted directly on the housing member 18 or may be integrated therewith. By means of an oil supply line or conduit 24 and a drain line or conduit 25 the control means 20 is connected to a convenient source of pressurized oil (not shown). The control means 20 can be operated by a suitable command transmitter via signalling or signal lines 26.

The intermediate shaft 13 comprises an end section **13*a* having a relatively small outer diameter which may be appropriately joined to the clutch or coupling sleeve 12. A central or intermediate section 13*b* of the intermediate shaft 13 has a larger outer diameter; it is contiguous to the end section 13*a* and is surrounded by the housing member 18. As will be particularly evident from FIG. 2, the housing member 18 contains a central or intermediate housing portion 31** and two support rings 32 and 33 which are mounted to the end walls thereof by means of threaded bolts 30. Each support ring 32, 33 is supported at the central section 13*b* of the intermediate shaft 13 by a bearing bush 34 and is sealed therefrom by means of a sealing arrangement 35. All the members 31 to 34 and the members or parts forming the sealing arrangement 35 are each formed in one-piece in circumferential direction and can be pushed onto the central or intermediate section 13*b* of the intermediate shaft 13 over the end section 13*a*.

The housing portion 31 has an end portion 31*a* facing the propeller shaft 6 and connected to the support ring 32. The end portion 31*a* extends over three axially spaced separating rings 36*a*, 36*b* and 36*c*, defining a distributor or separator ring structure, which are displaceably supported at the intermediate shaft 13 and delimit two mutually separate annular passages or channels 38 and 39 surrounding the intermediate shaft 13. The separating rings 36*a*, 36*b* and 36*c* are each provided with a groove 40 extending around the outer or exterior circumference thereof, each of which grooves 40 receives a sealing ledge 37 protruding past the circumferential surface. The sealing ledges 37 are sealingly guided in the bore 31' of the end portion 31*a*. A relief passage or channel 29 connects the space or chamber enclosed between the separating ring 36*a* and the sealing arrangement 35 of the support ring 32 to a space or chamber or lower pressure which is located between the separating ring 36*c* and the sealing arrangement 35 of the support ring 33.

The separating rings 36*a*, 36*b* and 36*c*, constituting the distributor ring structure, are formed in one-piece in circumferential direction and are fixedly interconnected in axial direction by a number of webs or bridging members 41 which are distributively arranged in circumferential direction about each one of the two annular passages or channels 38 and 39, so that axial sections of a distributor or ring or distributor ring structure are formed. The bridging members or webs 41 are designed so as to be bendable in radial direction, and within the respective annular passages 38 and 39 these webs 41 delimit freely through-flowable radial openings 43. The separating rings 36*a*, 36*b* and 36*c* are non-rotatably retained in the housing portion 31*a*, so that a displaceable sealing arrangement is obtained for the annular passages or channels 38 and 39 at the high surface-finished intermediate shaft 13. In corresponding manner the bore 31' in the housing portion 31 can be formed with relatively little working effort. In accordance with FIG. 2, a lock bolt 42 or the like, traversing the end portion 31*a*, can be provided as a retaining or holder element which extends into one of the openings 43 in one of the web or bridging members 41.

The annular passages or channels 38 and 39 are connected, on the one hand, by a supply passage or channel 44 and 45, respectively, in the housing portion 31 to the control lines 22 and 23, respectively, and are connected, on the other hand, to the bore 48 of the intermediate shaft 13 by connecting passages 46 and 47, respectively, which radially traverse the intermediate shaft 13. A bushing 50 is inserted into the bore 48, and a control rod 51 coaxially arranged with respect to the intermediate shaft 13 is axially displaceably and sealingly guided in the bushing 50. The bushing 50 is secured to the end of the intermediate shaft 13 which faces the propeller shaft 6 and is sealed therefrom by a sealing ring 52. Together with the wall of the bore 48 the bushing 50 limits two annular gaps or spaces 54 and 55 which are positioned behind one another in axial direction and which are sealed with respect to one another in a manner not here shown in greater detail. The annular gap 54 extends over the largest part of the length of the bushing 50 and is connected to the connecting passage or channel 46, while the connecting passage or channel 47 opens into the annular gap 55. The bore 48 is closed at the end of the intermediate shaft 13 which faces the drive shaft 15.

Together with the inner wall of the bushing 50 the control rod 51 delimits two inner annular gaps or spaces 56 and 57, each of which extends over about half the length of the control rod 51 and which are sealed from each other. Each of the inner annular gaps or spaces 56 and 57 is connected to the outer annular gaps or spaces 54 and 55, respectively, by ports 58 and 59, respectively. Furthermore, the control rod 51 is provided with a coaxial bore 61 and a number of, for example, six bores 60 which extend in parallel thereto and which are arranged in circumferential distribution about the bore 61; one of the bores 60 extends over the length of the control rod 51. Each bore 60 is connected to the inner annular gap or space 56 by a respective radial port 62, while the bore 61 is connected to the inner annular gap or space 57 by a corresponding radial port 63.

The end of the control rod 51 which faces the propeller shaft 6 extends from the end of the bushing 50 which is flush with the end of the intermediate shaft 13. This end of the control rod 51 is connected to an outer or exterior tube 65 by a flange connection 64 as well as to an inner or interior tube 67 which can be inserted into the bore 61 by a plug-type connection 66. The outer tube 65 and the inner tube 67 are guided through the propeller shaft 6 into the hub 8 of the adjustable pitch propeller 7. The inner tube 67 thus forms a control passage 69 connected to the bore 61 and limits together with the outer tube 65 an annular control passage or channel 68 which concentrically surrounds the control passage or channel 69 and into which the bores 60 open. In a manner known as such the outer or exterior tube 65 and the inner or interior tube 67 are connected within the hub 8 to an adjusting member like, for example, a piston of the servo motor 100. Thus, as also known, the control passages 68 and 69 can be respectively connected to cylinder chambers or spaces of the servo motor 100 and which can be subjected to pressures acting in opposite directions, the adjustment of the propeller vanes 10 being dervied from a corresponding stroke of the piston.

The control rod 51 is rigidly connected to the piston of the servo motor 100 and has a free end remote from the propeller shaft 6. This free end of the control rod 51 is guided in that portion of the bore 48 which is contiguous to the bushing 50 and which surrounds the control rod 51 with radial play. The control rod 51 is thus guided for displacement within a range of displacement H, corresponding to the piston stroke of the servo motor 100, between a first end or terminal position which is shown in full lines in FIG. 2 and a second end or terminal position 51' which is shown in dash-dotted lines in FIG. 2. At the central or intermediate section 13*b* the intermediate shaft 13 is provided with a diametrically extending slot 71 extending in parallelism with respect to the lengthwise axis thereof. The slot 71 serves as a guiding or guide means for an entrainment member 72 connected to the control rod 51 and positioned transversely relative to the lengthwise axis thereof. The ends of the entrainment member 72 protruding from the slot 71 are connected to a guiding or guide ring 73 which is axially displaceably supported at the central section 13b and which is correspondingly displaceable through the adjusting or adjustment range H between the first end position shown in full lines and the second end position 73' shown in dash-dotted lines. The guiding ring 73 is provided with a groove 74 extending around the circumference thereof which serves to guide an adjusting or adjustment lever 75 engaging with the groove 74 by means of a slide ring. The adjusting lever 75 is linked to the housing portion 31 for pivoting about an axis or pivot shaft 76 and is connected with a position indicator 77 arranged outside the housing portion 31.

Figure 2:
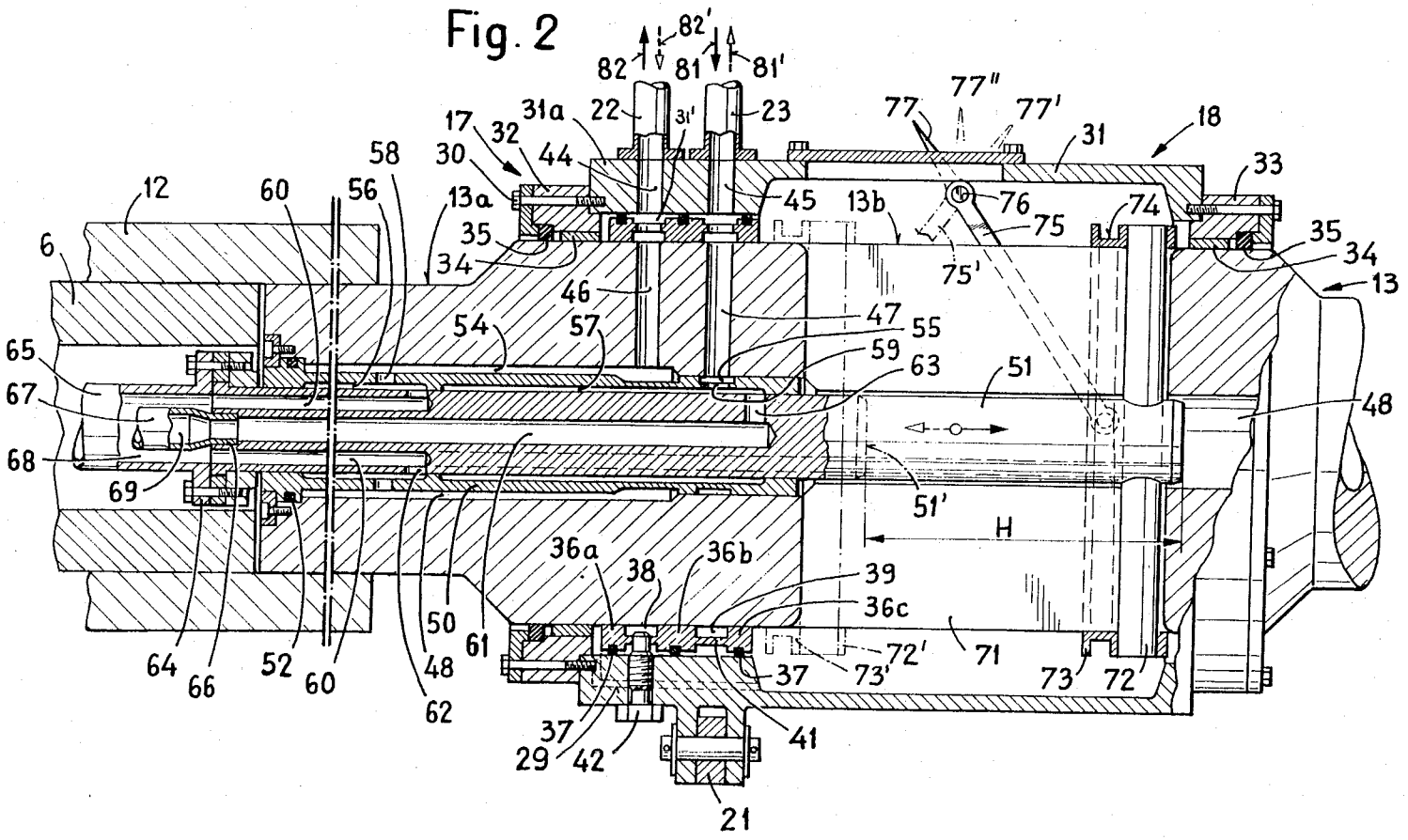
FIG. 2 is a partial longitudinal sectional view, depicted on an enlarged scale, of a detail of the oil infeed device shown in FIG. 1.

As will be evident from FIG. 2, the momentary axial position of the adjusting member of the servo motor 100 which is rigidly connected to the control rod 51 can be precisely detected. Thus, an indication of the correspondingly adjusted pitch angle of the propeller vanes 10 can be communicated and which indication is independent of the command transmission. Thus, the position of the adjusting lever 75 and the position indicator 77, as shown in FIG. 2 by solid or full lines, may correspond to the adjustment of the propeller vanes 10 for forward or ahead travel, while the dash-dotted or phantom line positions 77' and 75', respectively, correspond to the adjustment of the propeller vanes 10 for rearward or astern travel, and the center position 77'' corresponds to a practically ineffective neutral position of the propeller vanes 10.

In the position of the control rod 51 as shown in FIG. 2 and corresponding to forward or ahead travel of the vessel, the control line or conduit 23 is connected in accordance with arrow 81 to the oil supply line 24 via the correspondingly adjusted control means 20, see FIG. 1, and according to the arrow 82 the control line or conduit 22 is connected to the oil drain line 25. In corresponding manner, the related cylinder space or chamber of the servo motor is subjected to oil pressure via the annular gaps or spaces 55 and 57 as well as the bore 61 and the control or inner passages 69 and is under the operating pressure required for the corresponding operating position of the propeller vanes 10. The other cylinder space or chamber which may be impinged via the annular gaps or spaces 54 and 56 as well as the bores 60 and the control or outer passage 68 is relieved. When the control means 20 is appropriately set, then, the control line 22 is connected to the oil supply line 24 in accordance with the arrow 82' and the control line 23 is connected to the oil drain line 25 in accordance with the arrow 81'. The propeller vanes 10 are then each adjusted into the operating position for rearward or astern travel and the control rod 51 is thus displaced into the corresponding position 51'. The longitudinal dimensions of the annular gaps or spaces 54, 56 and 57 and of the bores 60 and 61 as well as the position of the ports 58, 59, 62 and 63 are adapted to each other in a known manner in such a way that the connection between the annular gap or space 54 and the bores 60 as well as the connection between the annular gap or space 55 and the bore 61 is ensured in any axial position of the control rod 51 within the displacement range H.

Figure 3:
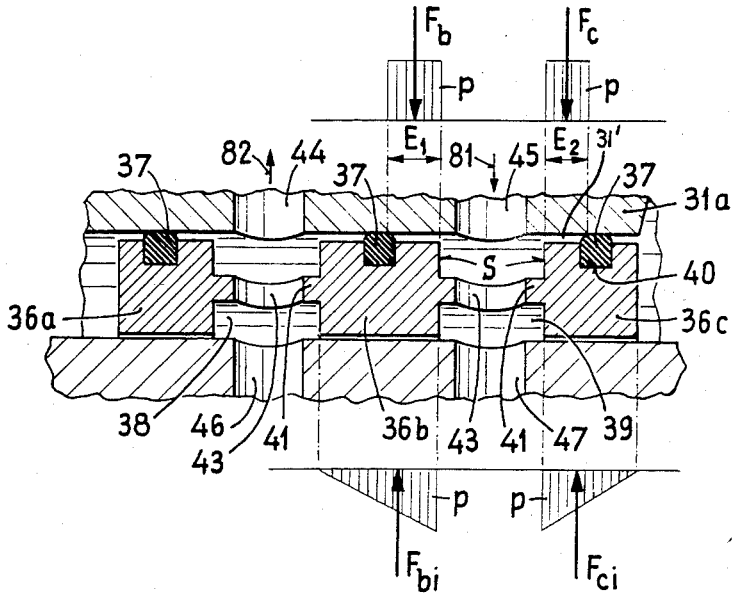
FIG. 3 is a further detail view, again on an enlarged scale of the oil infeed device shown in FIG. 2, schematically showing the hydraulic pressure forces acting upon members of the oil infeed device during operation thereof.

As will be seen in FIG. 3, the separating rings 36a, 36b and 36c each extend at such a radial distance from the surrounding wall of the bore 31' in the end portion 31a of the housing 18 that the full oil pressure p effective in the corresponding annular passage or channel 38 and 39, respectively, acts over the entire circumference on those portions of the outer circumferential surfaces of the separating rings 36a, 36b and 36c which extend from the respective sealing ledges 37 towards the respectively adjacent annular passage or channel 38 and 39. Corresponding to the illustration in FIG. 3, the separating rings 36a, 36b and 36c are each supported at the intermediate shaft 13 with a small radial play which permits the formation of a lubricating gap or clearance. In both the lubricating gaps or clearances which delimit the respective pressurized annular passage 38 or 39, a pressure prevails which is effective over the entire circumference and substantially over the entire length of the respective separating rings 36a and 36b or, respectively, 36b and 36c. This effective pressure continuously decreases in axial direction with increasing distance from the annular passage 38 or 39, respectively, from a maximum value corresponding to the oil pressure p to zero, i.e. to the pressure prevailing in the remaining part of the housing member 18.

The pressure conditions are shown in FIG. 3 for the annular passage or channel 39 connected to the oil supply according to the arrow 81. In correspondence with this illustration two pressure forces $F_b$ and $F_c$ result from the pressure acting on the outer circumferential surfaces of the separating rings 36b and 36c, each of which counteracts a radially outwardly directed pressure force $F_{bi}$ and $F_{ci}$, respectively, which results from the pressure acting on the inner circumferential surface of the separating rings 36b and 36c, respectively. In correspondence with the assumption made in FIG. 3, the continuous decrease of the pressure prevailing in the respective lubricating gap or clearance can occur at least approximately linearly, so that a triangularly-shaped load area results. The position of the mass center thereof determines the distance of the resulting pressure force $F_{bi}$ or $F_{ci}$, respectively, from the end wall S of the separating ring 36b or 36c, respectively, which bounds the annular passage or channel 39. This distance corresponds to one-third of the axial length of the separating ring 36b or 36c, respectively, at a linear pressure decrease. The portions of the outer circumferential surfaces of the separating rings 36b and 36c subjected to the oil pressure p each have an axial length $E_1$ and $E_2$, respectively, which corresponds to the axial distance of the effective sealing face or surface of the sealing ledge 37 from the end wall S of the separating ring 36b and 36c, respectively, which is subjected to the pressure. The distance of the resulting pressure force $F_b$ and $F_c$ from the respective end wall S thus is half of the effective axial length $E_1$ and $E_2$, respectively. As will be evident from FIG. 3, the two outer separating rings 36a and 36c each may have a smaller axial length than the central separating ring 36b. The correspondingly associated sealing ledges 37 each may be arranged at such a distance from the end wall S facing the pressure-subjected annular passage or channel 39 that the effective axial length $E_2$ is at least approximately equal to the effective axial length $E_1$ of the central separating ring 36b.

When the annular passage or channel 39 is pressurized the pressure forces $F_b$ and $F_c$ act on the mutually facing shoulders of the separating rings 36b and 36c and a moment of force is exerted on the separating rings 36b and 36c approximately about the boundary line of the sealing face of the corresponding sealing ledge 37 which faces the annular passage 39. This moment of force counteracts the moment of force due to the pressure force $F_{bi}$ and $F_{ci}$, respectively, acting on the inner circumferential surface in respect of the same boundary line of the sealing ledge 37. The moments of force due to the pressure forces $F_b$ and $F_c$ each exceed the moment of force due to the pressure forces $F_{bi}$ and $F_{ci}$, respectively, which are approximately of the same magnitude but extend closer to the boundary line. The moments of force due to the pressure forces $F_b$ and $F_c$ each act in the sense of constricting the respective opening of the corresponding lubricating gap or clearance which is formed between the intermediate shaft 13 and the separating ring 36*b* and 36*c*, respectively, and which faces the annular passage or channel 39. Due to the radially flexible design of the webs or bridging members 41 the separating rings 36*a*, 36*b* and 36*c* are fixedly interconnected in axial direction but are each elastically deformable in radial direction and independent of each other. In corresponding manner the separating rings 36*b* and 36*c*, subjected to oil pressure, can be deformed in the sense of a constriction of the lubricating gaps or clearances, thereby ensuring effective sealing of the annular passage or channel 39 in both axial directions and simultaneous lubrication of the bearing surfaces or faces.

As shown, the sealing ledges 37 each may be structured as an O-ring from rubber or a similar elastic sealing material or may comprise a combination of a rubber ring with a plastic supporting ring. In corresponding manner the position of the boundary lines of the sealing surfaces or faces results from the respective deformation of the sealing ledges 37 pressed against the bore of the end portion 31*a*. If desired, piston-ring-type sealing ledges made of metal also can be used.

In accordance with the illustration of FIGS. 2 and 3 the webs or bridging members 41 each may be formed by a ring member which is continuous in circumferential direction and in which ring member the openings 43 are formed. Also, the webs or bridging members 41 may comprise ring segments distributively arranged about the circumference and the openings may be formed between the ring segments. Instead of three interconnected separating or separation rings there also may be provided two pairs of separating rings, each pair of which is associated with one of the oil supply passages and bounds an annular passage or channel, the dimension of which in axial direction may be selected independently of the distance between the oil supply passages or channels.

While there are shown and described present preferred embodiments of the invention, it is to be distinctly understood that the invention is not limited thereto, but may be otherwise variously embodied and practiced within the scope of the following claims.

Accordingly, what I claim is:

1. An oil infeed device for a hydraulic servo motor of an adjustable pitch propelier, comprising:

a non-rotatable housing member having a bore;

a hollow intermediate shaft for operating said servo motor;

said hollow intermediate shaft being arranged in said bore of said housing;

control means for controlling the supply of pressurized oil;

two oil supply passages formed in said housing member and flow connectable to said control means;

distributor ring means sealingly arranged in said bore of said housing and supported on said intermediate shaft;

axial sections formed at said distributor ring means;

two annular channels formed by said axial sections and extending about the circumference of said intermediate shaft;

each of said oil supply passages opening into a respective one of said two annular channels;

each said axial section comprising a seal-less inner bearing surface;

each said inner seal-less bearing surface bounding a respective bearing gap formed with said intermediate shaft and open in both axial directions;

each axial section having a larger diameter which is smaller than the diameter of said bore of said housing member in order to form a gap permitting radial adjusting displacements of the related one of said axial sections;

radially flexible holding means interconnecting neighboring ones of said axial sections operatively associated with the same annular channel;

annular sealing ledges extending around an outer circumference of said distributor ring means on both sides of side annular channels for sealingly guiding said distributor ring means in said bore of said housing member;

connecting passages formed in said intermediate shaft and connecting said annular channels to working chambers of the servo motor; and said radially flexible holding means permitting said radial adjusting displacements of each said related one of said axial sections to provide for good sealing contact of said annular sealing ledges against said bore of said housing member.

2. The oil infeed device as defined in claim 1, wherein:

each said sealing ledge on said distributor ring means is made of a flexible material.

3. The oil infeed device as defined in claim 1, wherein:

each said sealing ledge on said distributor ring means is radially yieldably supported at a respective one of said axial sections.

4. The oil infeed device as defined in claim 1, wherein:

said holding means comprise a number of bridging members bendable in radial direction;

said bridging members being circumferentially distributed about said annular channels; and each said bridging member being fixedly connected to two neighboring ones of said axial sections of said distributor ring means and defining radial openings.

5. The oil infeed device as defined in claim 1, further including:

means for coupling said distributor ring means to said housing member so as to be stationary at least in circumferential direction.

6. The oil infeed device as defined in claim 1, wherein:

each of said axial sections bounding a respective one of said annular channels and forming an end face facing a related one of said annular channels;

each axial section having an axial length;

each said sealing ledge forms a line of contact with a wall of said bore of said housing member; and said axial length amounting to at least approximately twice the distance of said end face from said line of contact which is adjacent the related annular channel.

* * * * *